United States Patent [19]

Goldring

[11] Patent Number: 4,800,060

[45] Date of Patent: Jan. 24, 1989

[54] WINDOW ASSEMBLY FOR POSITRON EMITTER

[75] Inventor: Gvirol Goldring, Rehovot, Israel

[73] Assignee: Yeda Research & Development Co., Ltd., Rehovot, Israel

[21] Appl. No.: 404,851

[22] Filed: Aug. 3, 1982

[51] Int. Cl.[4] ..... G21G 1/10

[52] U.S. Cl. ..... 376/202; 376/194; 376/199

[58] Field of Search ..... 376/156, 157, 190, 194, 376/195, 199, 201, 202, 108, 158, 159, 196, 272, 340, 341, 342; 250/507.1, 517.1, 505.1, 506.1, 515.1

[56] References Cited

U.S. PATENT DOCUMENTS

| | | | |
|---|---|---|---|
| 3,525,228 | 8/1970 | Anderson | 376/202 |
| 3,546,512 | 12/1970 | Frentrop | 376/108 |
| 3,675,072 | 7/1972 | Hahn et al. | 376/202 |
| 3,981,769 | 9/1976 | Winchell et al. | 376/201 |
| 4,158,769 | 6/1979 | Smith | 250/505.1 |
| 4,324,980 | 4/1982 | Symmons | 250/505.1 |

*Primary Examiner*—Deborah L. Kyle
*Assistant Examiner*—Richard L. Klein
*Attorney, Agent, or Firm*—Browdy & Neimark

[57] ABSTRACT

There are provided container vessels for the production and transportation of short-lived isotopes by irradiation from an accelerator, comprising a hermetically sealed container with a window in one of its walls which fits the exit window of such accelerator, and through which a suitable material contained in the said container vessel can be irradiated. There is also provided a method for the production of such short-lived positron sources for use in tomography, which comprises attaching a container vessel defined above adjacent to the exit window of an acceletator, irradiating a suitable material in said container, detaching the said container and working up the positron source in a radiochemistry laboratory.

10 Claims, 2 Drawing Sheets

FIG. 4a
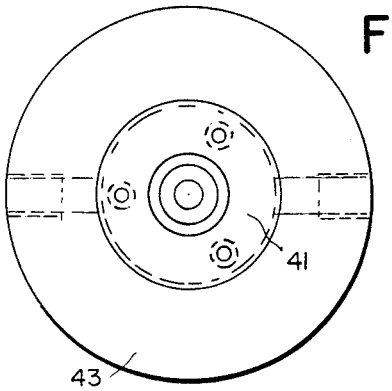
FIG. 5
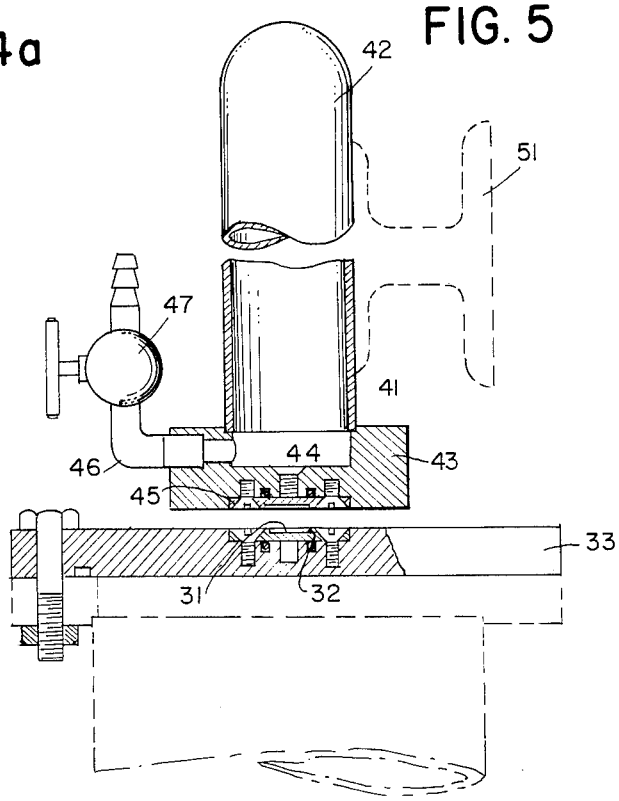
FIG. 4b
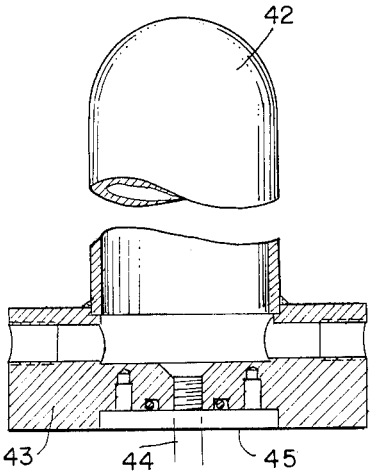
FIG. 6a
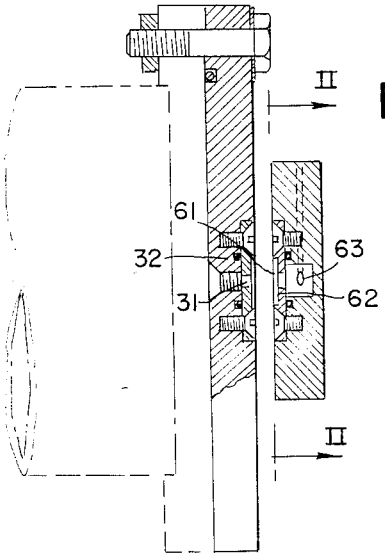
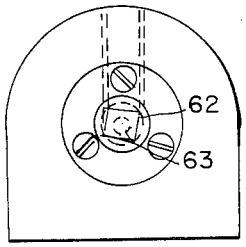
FIG. 6b

WINDOW ASSEMBLY FOR POSITRON EMITTER

FIELD OF THE INVENTION

The invention relates to containers wherein short-lived isotopes are produced by irradiation from an accelerator, which containers are self-contained and detached from such accelerator after irradiation, transported to a radio-chemistry laboratory and worked up for immediate use. Such containers are specially suitable for the preparation of isotopes for use as positron sources for tomography. The containers have a window (thin metal foil or the like) which fits the exit window of such accelerator, and after the particle beam passes through the two windows, it converts the element in said container to the desired isotope. The material which is irradiated may be in solid, liquid or gaseous form. This material is generally designated as "target material" and thus the container unit may be designated as "target assembly."

BACKGROUND OF THE INVENTION

Positron tomograpy is emerging now as a powerful tool for clinical diagnostics. In essence it involves a radiative scanning device coupled with positron emitting radioactive sources that are introduced into specific organs or tissues. The positrons decay by the emission of two gamma rays in diametrically opposed directions, and the scanning of those gamma pairs allows a detailed and accurate three dimensional mapping of the area of interest to be performed.

Typical sources employed in positron tomography have to be isotopes of materials that can easily be introduced into biological molecules. The most commonly employed materials $^{11}C$ with a half life of 20.5 min and $^{18}F$ with half life of 110 min. The short lifetimes of these sources provide added advantages: the patients are not exposed to excessive radiation and the safety precautions in handling these materials can be simple, since accidental spills will not produce any lasting contamination. The short lifetimes of the positron sources have, however, another important consequence: the sources have to be produced in the immediate vicinity of their eventual use and since those positron sources can be produced only with the air of particle accelerators, this implies having suitable accelerators established on hospital sites. The proper running of a positron tomography facility requires the adaptation of the accelerator operation, the source production, the radio chemistry and the scanning to hospital practices and norms.

PRODUCTION OF SOURCES, STATE OF THE ART

The $^{11}C$ and $^{18}F$ sources are produced by accelerators, usually cyclotrons, capable of generating beams of protons and deuterons of an energy of between 10 and 20 MeV. The sources are normally produced in materials which are either in gaseous (i) or in liquid (ii) form. Typical examples are:

(i) $^{20}Ne+d \rightarrow {}^{18}F+\alpha$; $^{14}N+p \rightarrow C+\alpha$ (ii) $^{18}O+p \rightarrow {}^{18}F+4$ with $^{18}O$ in $H_2\,^{18}O$.

As the gaseous and liquid materials cannot be introduced into the accelerator vacuum, the beam is passed through a thin, air-tight metallic foil (usually called "window") as in FIG. 1.

PROBLEMS ASSOCIATED WITH THE CONVENTIONAL METHOD

There are a number of problems and difficulties associated with the current method of producing positron sources:

I. It is difficult to handle the positron sources (e.g. extract the material from the target assembly in FIG. 1) in the close proximity of the accelerator and the high level of radiation which may prevail in that area.

II. It is difficult to inspect the window and to change it, if necessary.

Both problems are aggravated by the rapid turnaround expected: source material will have to be exchanged repeatedly and routinely within time intervals of the order of 10 or 20 minutes.

SUMMARY OF THE INVENTION

The invention relates to self-container vessels, provided with an inlet window for passage of a particle beam from an accelerator, adapted to be attached to the outlet window of such accelerator. In such vessel a suitable target material is irradiated and thus the desired short-lived isotope, preferably a positron source for use in positron tomography, is produced. The vessel (container) is removed from the accelerator, the isotopes are worked up in a safe and convenient location and used within a short time due to their short half-life.

BRIEF DESCRIPTION OF THE DRAWINGS

Self-contained container vessels according to the invention are illustrated with reference to the enclosed schematical drawings, which are not according to scale and in which:

FIG. 4*a* and 4*b* are a front view and a sectional side view through an embodiment of a container of the invention, suited for a gaseous target material FIG. 5 is a side view in partial section of a container of the invention attached to an accelerator outlet (combination of the unity in FIG. 3, 4).

FIGS. 6*a* and 6*b* are a side view in partial section of a container suited for liquid target material, attached to an accelerator and front view of said container.

Figure 1:
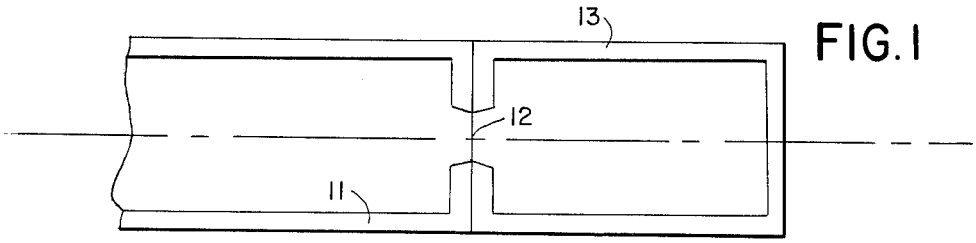
FIG. 1 PRIOR ART
FIG. 1 illustrates a conventional container attached via a single window to an accelerator.

DESCRIPTION OF THE PREFERRED EMBODIMENTS:

As shown in FIG. 1 a conventional arrangement, not according to the invention comprises an accelerator 11 provided with a window 12 which is in common with the container 13 in which there is positioned the material to be irradiated and converted to a positron source. This must be removed after such irradiation, and the handling in the vicinity of the accelerator is inconvenient and time consuming.

Figure 2:
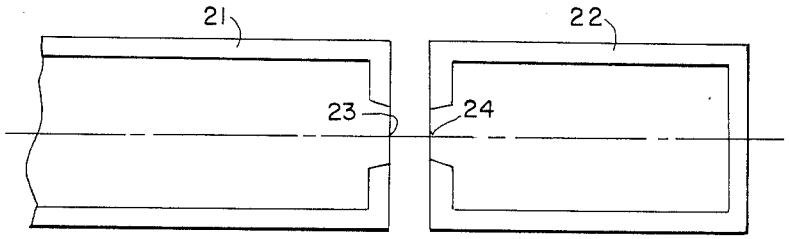
FIG. 2 illustrates a container according to the invention attached to a conventional accelerator.
Figure 3A:
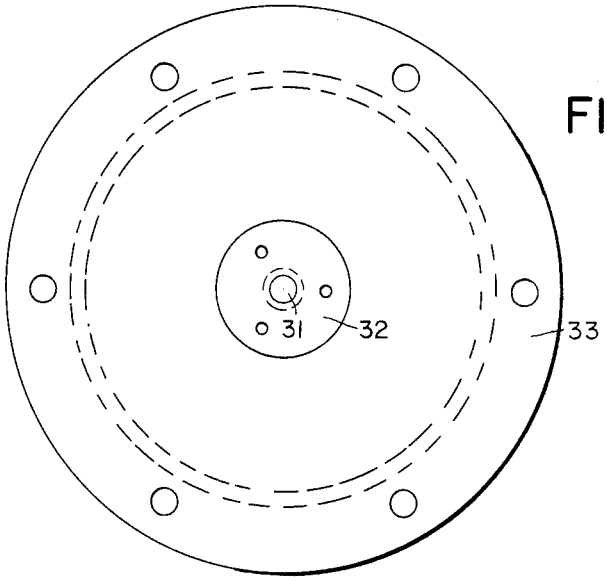
FIG. 3*a* and 3*b* are a front view and a sectional side view of the end flange of an accelerator figuring as part of the invention.
Figure 3B:
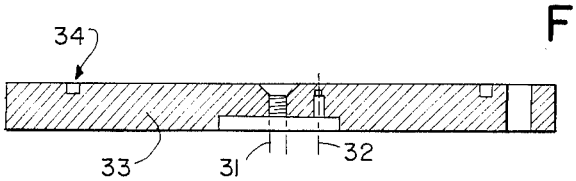

The arrangement shown in FIG. 2 comprises an accelerator 21 in combination with container vessel 22, the accelerator outlet being provided with a window 23, and the vessel with a window 24, which when in use, are positioned close to each other. After irradiation of the material in said container vessel 22 the container is removed to a suitable laboratory and worked up.

An embodiment used in tests with gaseous targets is illustrated in FIGS. 3*a*, 3*b*, 4*a*, 4*b*, 5 where 31 is a gas-tight window and 32 the window holder. The assembly is provided with flange means 33 and a vacuum seal by an O-ring in the groove 34 for the attachment and detachment to the outlet of the accelerator beam. In FIG. 4*a* and 4*b* a container 41 in the form of an elongated tube 41 with cap-formed end 42 forms an integral unit with the flange 43 which is brought near to the accelerator during irradiation, and which is provided with a gas-tight window 44 and a holder 45 which faces the outlet window of the accelerator. A full assembly of this type is illustrated in FIG. 5, where the tubular member 41 is provided with a support 51, said container being provided with inlet means 46 via valve 47.

A further container is illustrated in FIG. 6 with windows 31 and 61 (and holders 32, 62); the small target (in solid form) being designated by 63.

In all these embodiments, the accelerator beam passes through two windows: from the accelerator to the normal atmosphere (accelerator window) and from the atmosphere to the target material (target window). The target assembly becomes in this way a completely independent, detachable unit, and can be removed as a whole, or interchanged with another unit. The irradiated unit is transported to a radio chemistry lab and the source material is extracted there from the unit and treated chemically. By removing the target unit the accelerator window is exposed to convenient inspection and, if necessary, replacement. The windows are thin metal foil, such as nickel or molybdenum.

The Double Window assembly enables easy and safe handling of the positron sources. It also enables convenient inspection and handling of the accelerator window—a critical element in the source production process.

The only slight disadvantage of the assembly is the added degradation of the beam energy in the target window and the air between the two windows; however, for the reactions and beam energies that are normally considered (e.g. the examples given above) the reduction in beam energy and the attendant reduction in source strength is very small, not more than a few percent.

Tests were carried out with the assemblies shown in FIG. 3–6 and the following reactions and materials:

(i) $^{14}N$ (p,$\alpha$)$^{11}C$ with protons of 10 MeV. FIG. 3 shows the accelerator window assembly; the window was a nickel foil of 2 $\mu$m thickness and it is indicated as 31. Another assembly is shown in detail in 3b and 4b. The target assembly is shown in FIG. 4 and 4*b*. The target window was a nickel foil of 2 $\mu$m and it is indicated as 44.

(ii$^{18}O$(pn)$^{18}F$ with protons of 10 MeV. FIGS. 6*a* and 6*b* show the target assembly. The target window was a nickel foil of 2 $\mu$m and its position is indicated as 61, the target being indicated as 63.

I claim:

1. A system for the production and transportation of short lived isotopes, comprising:

accelerator means, having a vacuum chamber and a window, for directing an irradiating particle beam through said window;

container means for holding a material capable of being converted to short lived isotopes upon irradiation by the irradiating particle beam of said accelerator means, said container means comprising a hermetically sealed container having a window through which said irradiating particle beam can pass, said container window being separate and distinct from said window of said accelerator means.

2. A system in accordance with claim 1, wherein said window of said accelerator means and said window of said container each consists of a thin metal foil.

3. A system in accordance with claim 2, wherein each said thin metal foil window consists of nickel or molybdenum foil.

4. A system in accordance with claim 1, wherein said container is in the shape of an elongated tube with the window thereof being disposed at one of the ends of the tube.

5. A method for the production and transportation of short lived isotopes, comprising:

attaching a hermetically sealed container, having a window through which an irradiating particle beam can pass and containing a target material capable of being converted to short lived isotopes upon irradiation, to an accelerator, having a vacuum chamber and window which is separate and distinct from the window of the container;

irradiating the target material in the container by directing an irradiating particle beam through the window of the accelerator and the window of the container;

detaching the container; and transporting the container containing the irradiated target material.

6. A method in accordance with claim 5, wherein the window of the accelerator and the window of the container each consist of a thin metal foil.

7. A method in accordance with claim 6, wherein each thin metal foil window consists of nickel or molybdenum foil.

8. A method in accordance with claim 5, wherein said target material is a liquid or a gas.

9. A method in accordance with claim 5, wherein said target material is in gaseous form.

10. A method in accordance with claim 5, wherein said target material is selected such that it can serve as a positron source upon irradiation.

* * * * *